US005345727A

United States Patent [19]

McCrea

[11] Patent Number: 5,345,727

[45] Date of Patent: Sep. 13, 1994

[54] J-SHAPED TROUGH AND SUPPORTING MOUNT

[76] Inventor: Warren J. C. McCrea, 1046 Cedar Avenue, Burlington, Ontario, Canada, L7T 2S1

[21] Appl. No.: 45,881

[22] Filed: Apr. 15, 1993

[51] Int. Cl.[5] ..... E04D 13/00

[52] U.S. Cl. ..... 52/11; 52/12

[58] Field of Search ..... 52/11, 12

[56] References Cited

U.S. PATENT DOCUMENTS

| | | | |
|---|---|---|---|
| 3,417,519 | 10/1965 | Hitter | 52/11 |
| 4,262,459 | 4/1981 | Hallam | 52/11 |
| 4,551,956 | 11/1985 | Axford | 52/12 |
| 4,987,717 | 1/1991 | Dameron, Jr. | 52/11 |

FOREIGN PATENT DOCUMENTS

| | | | |
|---|---|---|---|
| 249373 | 2/1964 | Australia | 52/11 |
| 942028 | 2/1974 | Canada | 52/11 |
| 3606278 | 9/1987 | Fed. Rep. of Germany | 52/11 |
| 1143421 | 2/1969 | United Kingdom | 52/11 |

*Primary Examiner*—Carl D. Friedman
*Assistant Examiner*—Christopher Todd Kent

[57] ABSTRACT

A J-shaped trough and mounting/supporting bracket for draining rain water off of a roof keeps undesirable leaves and other debris out of the drainage system. The "J" shape allows the trough to be hidden under the soffit helping to keep leaves and other debris out.

1 Claim, 3 Drawing Sheets

J-SHAPED TROUGH AND SUPPORTING MOUNT

BACKGROUND OF THE INVENTION

1. Field of the Invention

The present invention relates generally to house gutters, and more particularly, to a J-shaped trough and support bracket especially adapted to drain roof water while keeping leaves and other unwanted debris out of the drainage system.

2. Description of the Prior Art

Roof drainage systems in the form of gutters are well known in the art of home maintenance. Examples of prior art devices used for roof drainage are shown in the following U.S. Pat. Nos.: 5,004,191; 4,987,717; 4,780,995; 3,815,302; 3,738,068; and 3,426,488.

Clogged gutters and downspouts are a common problem. Mesh covers have been used in the past in an attempt to keep leaves and other debris out of the gutters and downspouts. Unfortunately, mesh covers often blow off in the wind or snow and slush freezes into the mesh.

Thus, while the foregoing body of prior art indicates it to be well known to use gutter systems to direct roof drainage to a particular location, the provision of a more simple and cost effective device is not contemplated. Nor does the prior art described above teach or suggest a J-shaped trough with a mounting support bracket which may be used by individuals on their roofs to direct roof drainage without the system becoming clogged with leaves and other debris. The foregoing disadvantages are overcome by the unique J-shaped trough and bracket of the present invention as will be made apparent from the following description thereof. Other advantages of the present invention over the prior art also will be rendered evident.

SUMMARY OF THE INVENTION

To achieve the foregoing and other advantages, the present invention, briefly described, provides a J-shaped trough and mounting/supporting bracket therefor for draining rain water off of a roof while keeping undesirable leaves and other debris out of the drainage system. The "J" shape allows the trough to be at least partially hidden under the soffit keeping leaves and other debris out.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiment of the present invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new J-shaped trough and mounting support which has all of the advantages of the prior art and none of the disadvantages.

It is another object of the present invention to provide a new J-shaped trough and supporting mount which may be easily and efficiently manufactured and marketed.

It is a further objective of the present invention to provide a new J-shaped trough and supporting mount which is of durable and reliable construction.

An even further object of the present invention is to provide a new J-shaped trough and supporting mount which is susceptible of a low cost of manufacture with regard to both materials and labor, and which accordingly is then susceptible of low prices of sale to the consuming public, thereby making such J-shaped trough and supporting mount available to the buying public.

Still yet a further object of the present invention is to provide a new J-shaped trough and supporting mount which mounts under the soffit.

It is still a further object of the present invention to provide a new J-shaped trough and supporting mount which keeps unwanted debris out of the roof drainage system.

Still a further object of the present invention is to provide a new J-shaped trough and supporting mount including means for mounting and supporting the J-trough, all of which is simple to install, repair and replace.

Yet still a further object of the present invention is to provide a new J-shaped trough and supporting mount which eliminates the need for fascia board.

Even still a further object of the present invention is to provide a new and improved J-trough and supporting mount which will work with downspouts currently on the market.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved J-shaped trough and supporting mount embodying the principles and concepts of the present invention will be described.

Figure 1:
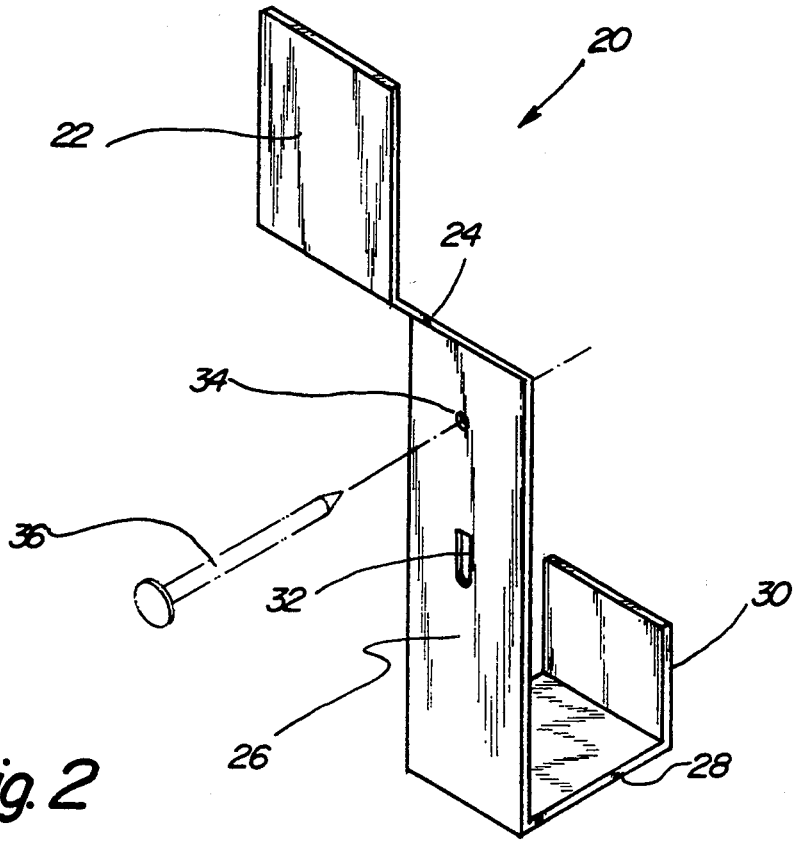
FIG. 1 is a perspective view in elevation showing the preferred embodiment of the mounting bracket of J-shaped trough of the present invention.
Figure 2:
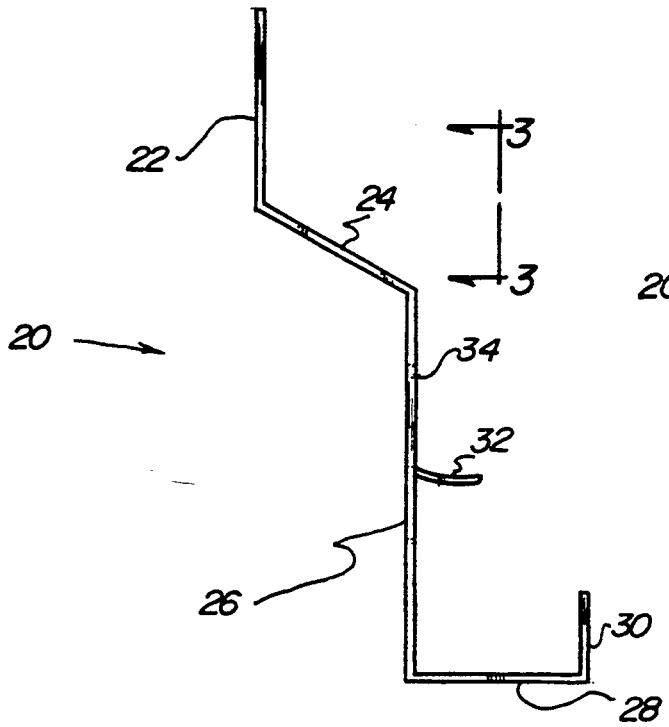
FIG. 2 is a side view of the mounting bracket of J-shaped trough of FIG. 1 in accordance with the present invention.
Figure 3:
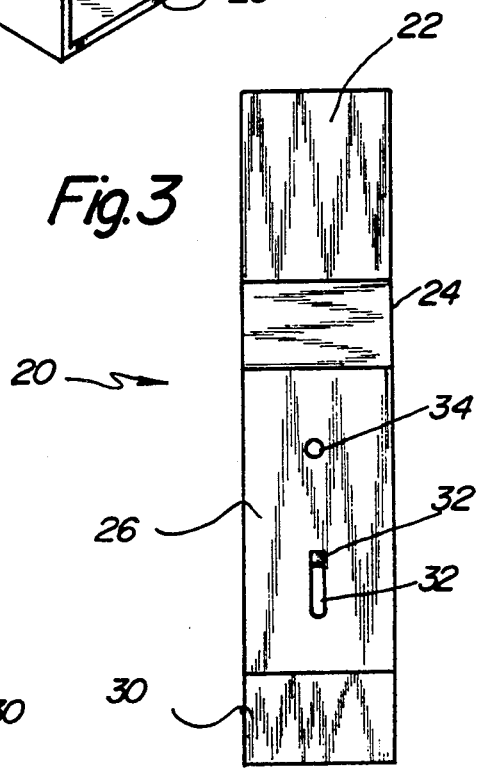
FIG. 3 is a back side view of the mounting bracket 1 J-shaped trough of FIGS. 1 and 2 taken along line 3—3 of FIG. 2.

Turning initially to FIGS. 1–3, there is shown a first exemplary embodiment of the mounting support bracket of the present invention generally designated by reference numeral 20. In its preferred form, mounting support bracket 20 comprises generally an upper vertical section 22 immediately below which is a slanted section 24. Immediately below the slanted section 24 is a lower main vertical section 26. Adjacent and perpendicular to the lower main vertical section 26 is a horizontal base 28. Adjacent and perpendicular to the other end of the horizontal base 28 is short vertical section 30.

The mounting bracket 20 also has a hole 34 through which a nail 36 (or screw or other elongated attaching means) can pass to attach and secure the bracket to a house. The nail 36 is preferably made of a galvanized metal material.

Figure 4:
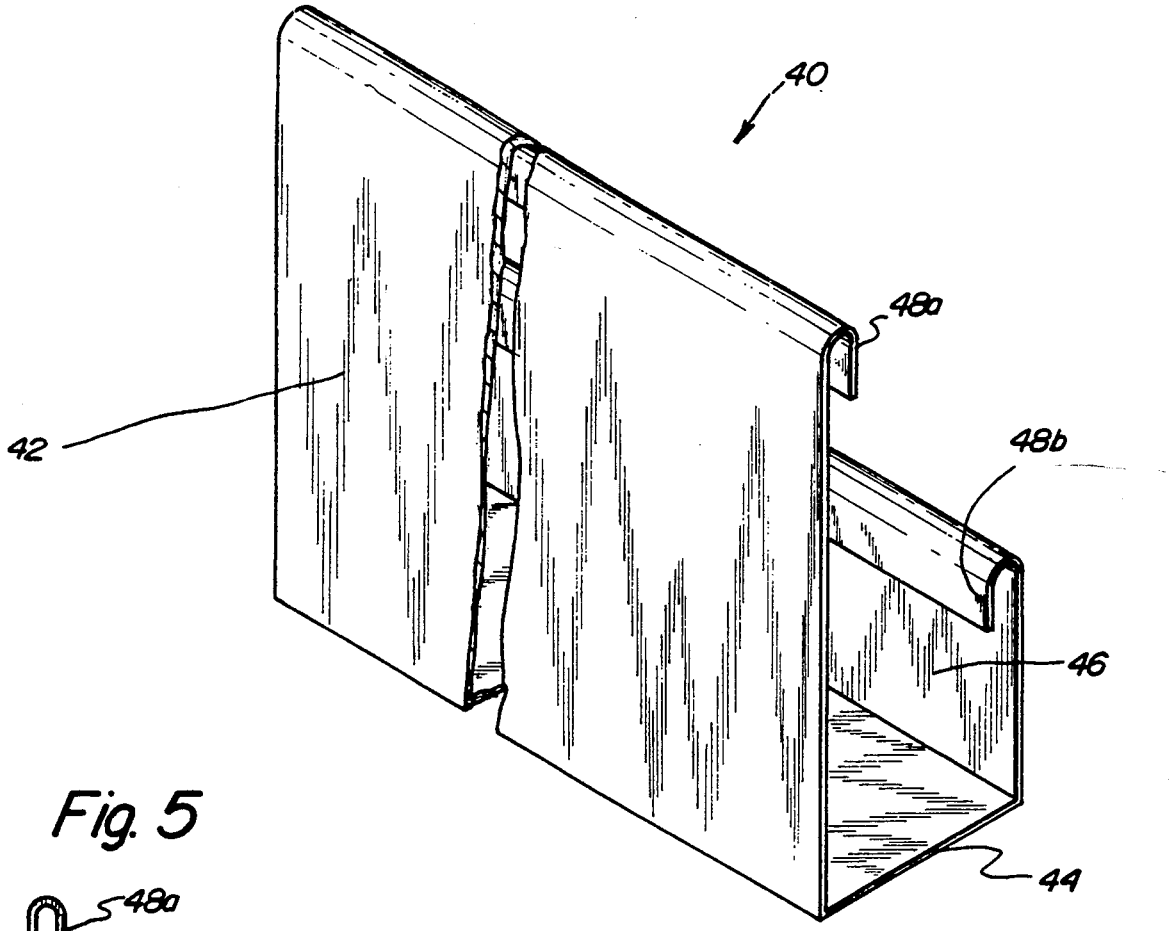
FIG. 4 is a perspective view in elevation of the preferred embodiment of the J-shaped trough of the present invention.
Figure 5:
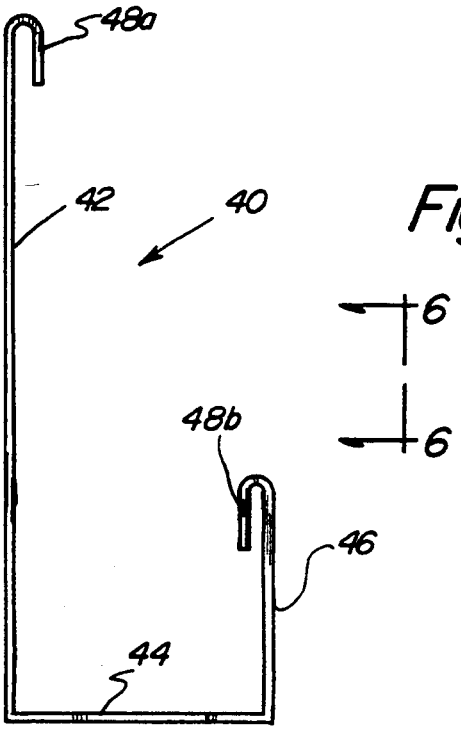
FIG. 5 is a side view in elevation of the J-shaped trough of FIG. 4 in accordance with the present invention.
Figure 6:
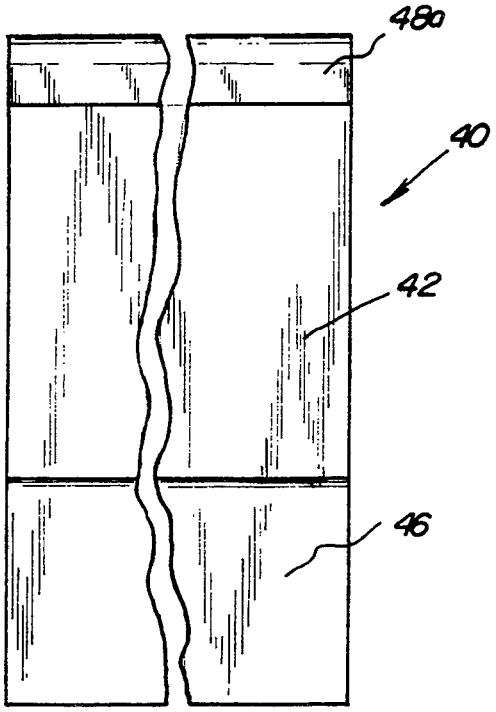
FIG. 6 is a back side of the J-shaped trough of FIGS. 4 and 5 taken along 6—6 of FIG. 5 in accordance with the present invention.

Mounting bracket 20 also has a knockout hole 32 above which perpendicularly extends locating dog 32'. The locating dog 32' is a knockout on three sides formed by the metal piece (or whatever material the bracket 20 is made of) "knocked out" to form knockout hole 32. Referring now to FIGS. 4–6, a J-shaped trough 40 comprises generally a long vertical section 42 and a short vertical section 46, between which is a horizontal base 44. At the top of long vertical section 42 is a first inverted-U-shaped catch piece **48*a*. At the top of short vertical section 46 is a second inverted-U-shaped catch piece 48*b***.

Figure 7:
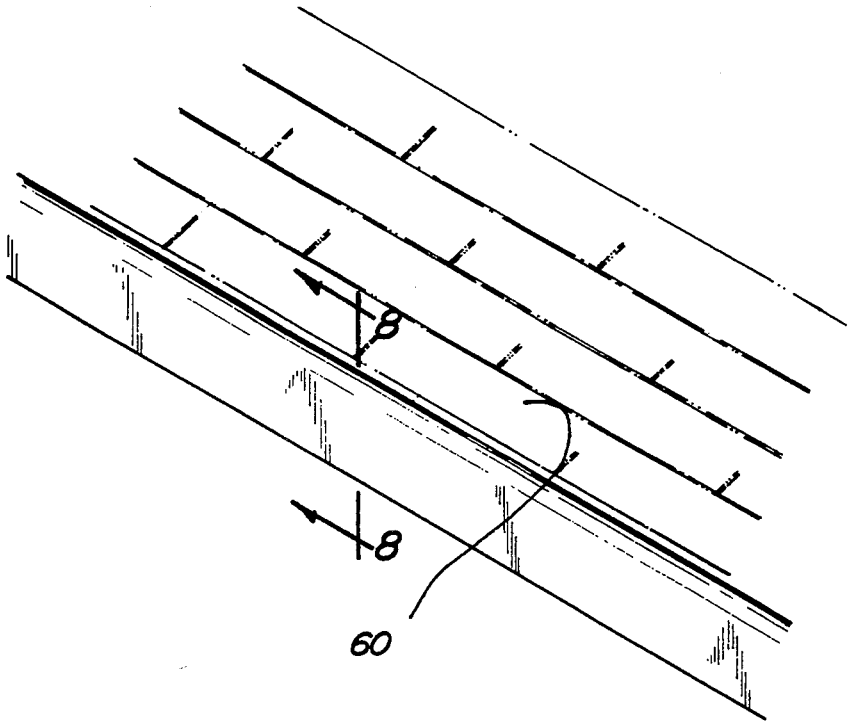
FIG. 7 is a perspective view in elevation of a roof having a J-shaped trough and mounting support brackets in accordance with the present invention.
Figure 8:
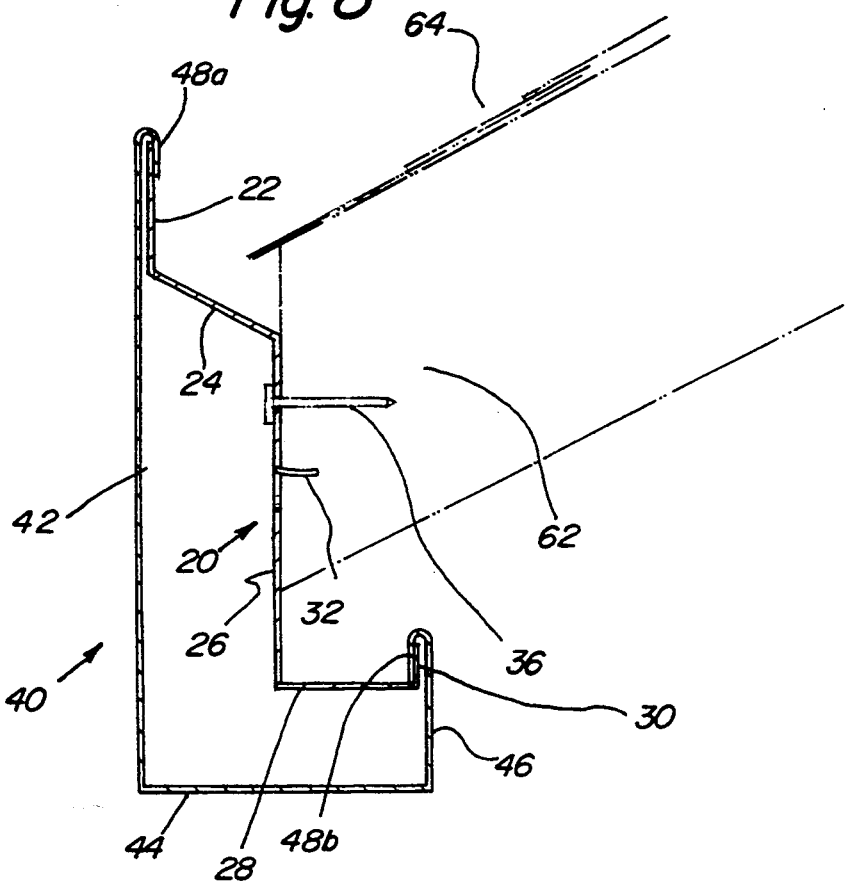
FIG. 8 is a cross-sectional side view taken along 8—8 in FIG. 7 showing a J-shaped trough and mounting support bracket mounted together to a house in accordance with the present invention.

Referring now to FIGS. 7 and 8, the combination of the J-shaped trough 40 with the mounting support bracket 20 is shown mounted to a house roof 60 having a roof rafter 62 and shingles 64.

The installing of the mounting support bracket 20 to the roof rafter 62 and the mounting of the J-shaped trough 40 onto the bracket 20 is very quick and easy. Referring particularly to FIG. 8, a nail 36 is driven through the hole 34 in a mounting support bracket 20 and into the roof rafter 62 of a house. The process is repeated for as many mounting support brackets 20 as are desired to support the length of J-trough 40 necessary to cover the perimeter of a roof 60. After the support brackets 20 have been lined up with each other and their respective nails 36 hammered in, the locating dog 32' for each bracket 20 is driven into the rafter 62 to prevent the bracket 20 from rotating around the nail 36.

Once the mounting support brackets 20 are in place, the first inverted-U-shaped catch piece **48*a* of the J-shaped trough 40 is hung over the edge at the top of upper vertical section 22 of mounting support bracket 20. Next, the second inverted-U-shaped catch piece 48*b* of the J-shaped trough is snapped into place over the edge at the top of short vertical section 30 of mounting support bracket 20. The process is repeated for all of the mounting support brackets 20** used.

The present invention keeps unwanted leaves and other debris out of a roof drainage system by using a J-shaped trough 40 and corresponding support mounts/brackets 20 which at least partially hides the trough 40 under the soffit. Using the support mounts 20 to hang the trough 40 makes it possible for one person to do the job of installing the present invention on a new house or, alternatively, replacing an old system on an older house with the present invention. Using the present invention, fascia board is not necessary reducing contractor labor and material costs and eliminating the need to paint the fascia. If any section of the J-shaped trough 40 becomes damaged, it can be replaced easily, quickly and inexpensively. Downspouts currently on the market will fit the J-shaped trough 40 of the present invention. End caps and corner pieces can be easily manufactured preferably using a single stroke stamping. The J-shaped trough 40 is preferably manufactured of standard gauge aluminum sheet shaped into preferably 12 foot sections. Of course, any suitable material and length thereof could be used for the present invention. The mounting support brackets 20 are preferably unfinished galvanized metal in a thickness strong enough to not deform under the pressure of a ladder leaning against the eave. Of course, the J-shaped trough and the mounting support bracket 20 could be manufactured out of any of a variety of materials including, but not limited to, galvanized steel (which is the preferred material), vinyl, or aluminum. The J-shaped troughs 40 could be produced in any color desired. Instructions for installation would be very simple and should be easily understood by most homeowners. Very few tools would be required to install the J-shaped troughs 40 and the supporting mounts 20.

At least two styles of mounting supports 20 could be produced. The first would be for new home construction where no fascia board exists. The second type would be for the do-it-yourself aftermarket where fascia is already in place.

It is apparent from the above that the present invention accomplishes all of the objectives set forth by providing a new and improved roof drainage system for any type of sloped. The system is comprised of a J-shaped trough and a means for fastening the J-shaped trough to the roof, such that the shape of the support minimizes the gap between the shingle and trough vertical section 42 so as to prevent leaves and other debris from entering the system (trough). The roof drainage device means for supporting the J-shaped trough can be a mounting support bracket. The J-shaped trough can be snapped onto the mounting support bracket. The J-shaped trough can be made of aluminum, vinyl or galvanized metal and the mounting support bracket can be made of galvanized metal. The mounting support bracket can be mounted to the roof rafter by a mounting nail. The mounting support bracket can have a locating dog which can be driven into the roof rafter to prevent the bracket from rotating around the nail. The J-shaped troughs can be produced in approximately 12 foot sections which can be cut and trimmed or combined to form any length.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A roof drainage system for mounting against the peripheral edge of a roof comprised of the combination of:

a J-shaped trough; and at least one mounting bracket for supporting said J-shaped trough on the periphery of said roof;

said mounting bracket comprising a first upstanding section, a base section extending orthogonally and rearwardly from the bottom of said first upstanding section, said base section terminating in a second upstanding section spaced rearwardly from and parallel to said first upstanding section, said second upstanding section terminating in a first edge for supporting said trough, said mounting bracket further comprising an angled section extending forwardly upwardly from the top of said first upstanding section and a third upstanding section extending upwardly from the top of said angled section and being spaced forwardly and parallel with respect to said first upstanding section, said third upstanding section terminating in a second edge for supporting said trough;

said trough having a first wall, a base extending orthogonally and rearwardly from the bottom of said first wall and a second wall extending orthogonally from said base and parallel to said first wall, said second wall terminating in a first lip for engaging said first edge of said second upstanding section of said mounting bracket, and said first wall terminating in a second lip for engaging said second edge of said third upstanding section of said mounting bracket wherein said base of said trough is spaced from and parallel to said base of said mounting bracket and said first wall of said trough is spaced from and parallel to said first upstanding section of said mounting bracket when said mounting bracket is mounted adjacent to said periphery of said roof.

* * * * *